US006067730A

United States Patent [19]

Woods

[11] Patent Number: 6,067,730

[45] Date of Patent: May 30, 2000

[54] TEXTILE DRYING SYSTEM SUITABLE FOR INSTALLATION IN A LAUNDRY ROOM LOCATED WITHIN OR ADJACET TO A CLEAN ROOM FACILITY

[75] Inventor: Robert L. Woods, Johnson City, Tex.

[73] Assignee: Advanced Micro Devices, Inc., Sunnyvale, Calif.

[21] Appl. No.: 09/167,963

[22] Filed: Oct. 6, 1998

[51] Int. Cl.[7] ..... F26B 11/02

[52] U.S. Cl. ..... 34/603; 34/606; 34/607

[58] Field of Search ..... 34/79, 85, 86, 34/595, 602, 603, 604, 606, 607; 68/3 R, 139

[56] References Cited

U.S. PATENT DOCUMENTS

| | | | |
|---|---|---|---|
| 1,423,188 | 7/1922 | Cardin | 34/603 |
| 1,720,537 | 7/1929 | Barthel et al. | 34/603 |
| 4,279,082 | 7/1981 | Commander | 34/607 X |
| 4,875,298 | 10/1989 | Wright | 34/607 X |
| 5,771,604 | 6/1998 | Wunderlich et al. | 34/603 |
| 5,881,473 | 3/1999 | Giogoli et al. | 34/607 X |

OTHER PUBLICATIONS

Huebsch 150 Drying Tumbler product brochure, published by Huebsch Originator, Ripon, Wisconsin, printed May 1992, 2 pages.

*Primary Examiner*—Stephen Gravini

*Attorney, Agent, or Firm*—Kevin L. Daffer; Conley, Rose & Tayon

[57] ABSTRACT

A textile drying system is presented which draws in a quantity of air from an external space substantially equal to a quantity of air exhausted to the external space. The textile drying system includes one or more textile drying appliances (i.e., dryers) and a single air handling unit. Each dryer has an air input port and an air output port. During use, the single air handling unit provides a first quantity of air from a space outside a room in which the one or more dryers are located to the air input port of each dryer. A second quantity of air is exhausted through the air output port of each dryer to the space outside the room, wherein the second quantity of air is substantially equal to the first quantity of air. As a result, the textile drying system does not draw air from, or provide air to, the room in which the textile drying system is located. When the room is adjacent to a clean room, the textile drying system does not create a vacuum which may disturb a vertical laminar flow of air within the clean room. The textile drying system is thus suitable for installation in a laundry room located within or adjacent to the clean room.

18 Claims, 2 Drawing Sheets

TEXTILE DRYING SYSTEM SUITABLE FOR INSTALLATION IN A LAUNDRY ROOM LOCATED WITHIN OR ADJACET TO A CLEAN ROOM FACILITY

BACKGROUND OF THE INVENTION

1. Field of the Invention

This invention relates to textile drying appliances (e.g., dryers), and more specifically to dryers used to dry garments associated with the semiconductor industry subsequent to cleaning the garments in a fluid (e.g., water) which is absorbed by the clean room garments.

2. Description of Related Art

It is well known that small particles (i.e., particulates) can cause defects in integrated circuits formed upon semiconductor wafers. Such defects may prevent the integrated circuits from performing their intended functions. For example, a process called photolithography is used to pattern layers of desired materials deposited upon the semiconductor wafers. During photolithography, light passing through a pattern on a mask transfers the pattern to a layer of light-sensitive photoresist deposited over the layer of the desired material. Particulates on the surface of the mask or on the surface of the photoresist layer which block or diffuse the light cause imperfect pattern registrations (i.e., imperfect feature formations). Such imperfect features formed within an integrated circuit may render the integrated circuit inoperable.

In order to help keep wafer processing areas as particle free (i.e., "clean") as possible, such areas are designated as "clean rooms". Particulates may be present within the air in clean rooms, introduced by processing personnel, suspended in liquids and gasses used during wafer processing, and generated by processing equipment located within the clean rooms. As a result, the air within clean rooms is typically continuously filtered. Liquids and gasses entering clean rooms and used during processing are also filtered, and clean rooms typically exclude portions of processing equipment which generate particulates.

Air "cleanliness" levels of clean rooms are determined by the densities of different sizes of particulates present in the air and are specified using class numbers. The allowable densities of particulates within clean rooms is dependent upon the clean room class numbers and the largest dimensions of the particulates. For example, a class 1 clean room can have only 1 particle with a largest dimension of 0.5 micron in each cubic foot of air, but may have up to 34 particles with largest dimensions of 0.1 micron per cubic foot of air. The required class number for a particular clean room is largely determined by the feature sizes of the integrated circuit devices being produced within the clean room. Portions of many integrated circuits produced today are formed within class 1 clean rooms.

Human beings continuously generate large numbers of particulates including dead skin cells and hairs. When working in clean rooms, personnel typically wear low-particle-generating coverings which almost completely envelope their bodies. The clean room garments essentially form filters around the wearers, reducing the number of particulates generated by the wearers which escape into the air.

Exemplary garments include overalls and hoods, face masks, safety glasses or goggles, leggings, shoe covers, and gloves. Undergarments such as caps or nets may also be used to keep hair in place under hoods.

In a typical clean room, filtered air is supplied from the ceiling and return air is drawn through a perforated floor, providing a continuous vertical laminar flow of filtered air. Particles released by clean room personnel and equipment are hopefully swept downward by the laminar flow of air before coming to rest upon surfaces of wafers or processing equipment.

Clean room garments must be laundered on a regular basis if they are to remain serviceable. Laundering clean room garments at an off-site facility presents a problem in that particles may be introduced into the garments during transport through the relatively "dirty" environment between the off-site facility and the clean room. In fact, the plastic bags routinely used to protect laundered garments are themselves particle generators, rendering them ineffective in protecting clean room garments from the introduction of particles during transit. One way of solving the problem of particle introduction during transport is to eliminate the need for transport by laundering the clean room garments in a laundering facility located within or adjacent to the clean room.

Problems arises when laundering clean room garments in a facility located within or adjacent to the clean room. Textile drying appliances (i.e., "dryers") typically operate by facilitating the vaporization (i.e., evaporation) of a liquid (e.g., water) within textiles (e.g., garments) placed within the dryers. The dryers continuously exhaust the vapor-laden air surrounding the textiles and draw in relatively vapor-free "makeup" air. The vapor-laden air is typically exhausted to an exterior space, and the makeup air is typically drawn from the room in which the dryers are located. Relatively large volumes of air drawn from a laundering room located within or adjacent to a clean room may create a vacuum which disrupts the vertical laminar flow of air within the clean room. This disruption in the vertical laminar flow of air may result in an increase in the number of particulates causing wafer defects.

It would thus be desirable to have a textile drying system which does not draw air from, or provide air to, a room in which the textile drying system is located. When located within or adjacent to a clean room, such a textile drying system would not create a vacuum which may disturb a vertical laminar flow of air within the clean room. The desired textile drying system would thus be suitable for installation in a laundry room located within or adjacent to the clean room.

SUMMARY OF THE INVENTION

The problems outlined above are in large part solved by a textile drying system which draws in a quantity of air from an external space substantially equal to a quantity of air exhausted to the external space. The textile drying system includes one or more textile drying appliances (i.e., dryers) and a single air handling unit. Each dryer has an air input port and an air output port. During use, the single air handling unit provides a first quantity of air from a space outside a room in which the one or more dryers are located to the air input port of each dryer. A second quantity of air is exhausted from each dryer through the air output port to the space outside the room, wherein the second quantity of air is substantially equal to the first quantity of air. As a result, the textile drying system does not draw air from, or provide air to, the room in which the textile drying system is located. When the room is within or adjacent to a clean room, the textile drying system does not create a vacuum which may disturb a vertical laminar flow of air within the clean room. The textile drying system is thus suitable for installation in a laundry room located within or adjacent to the clean room.

The dryers may operate by facilitating the evaporation of a liquid (e.g., water) contained within the textiles (e.g., garments) placed within the dryers. The first and second quantities of air may be sufficient to effect drying of the garments by evaporation. The first quantity of air is supplied under pressure by the air handling unit to achieve a desired air flow rate, and may be filtered and/or heated. The air handling unit may include a fan for pressurizing the air, a filter for filtering the air, and a heat exchanger for heating the air. The filter may include one or more filter elements. One of the filter elements may be a high efficiency particulate air (HEPA) filter element or an ultra low penetration air (ULPA) filter element.

The air handling unit may be located outside the room in which the dryers are located. The textile drying system may include ductwork for routing the first quantity of air from the air handling unit to the air input port of each dryer, and for routing the second quantity of air from the air output port of each dryer to the space outside the room.

In one embodiment, the textile drying system includes a first and second sets of dryers, wherein each set of dryers includes at least one dryer, and wherein each dryer has an air input port and an air output port. The air handling unit provides a first quantity of input air from the space outside the room to the input port of each dryer within the first set of dryers, and a second quantity of input air from the space outside the room to the input port of each dryer within the second set of dryers. Each dryer within the first set of dryers exhausts a first quantity of output air through the air output port to the space outside the room, wherein the first quantity of output air is substantially equal to the first quantity of input air. Similarly, each dryer within the second set of dryers exhausts a second quantity of output air through the air output port to the space outside the room, wherein the second quantity of output air is substantially equal to the second quantity of input air.

The dryers within the first set of dryers may operate at the same time (i.e., in unison). For example, the first set of dryers may include a pair of dryers each intended to dry half of a wash load produced by a washing machine. Correspondingly, the dryers within the second set of dryers may also operate at the same time. The first and second sets of dryers may operate independent of one another, and thus may or may not be in operation at the same time. In order to provide the correct quantities of air to the dryers, the air handling system may include a first damper to regulate the quantity of input air delivered to the first set of dryers, and a second damper to regulate the quantity of input air delivered to the second set of dryers. The first damper is in a open position only when the first set of dryers are in use, and is in a closed position otherwise. Similarly, the second damper is in a open position only when the second set of dryers are in use, and is in a closed position otherwise.

When the dryers of the first set of dryers are in use, the first quantities of input and output air may be sufficient to dry textiles located within the dryers of the first set of dryers by evaporation of a liquid contained within the textiles. The position of the open first damper is adjusted such that the first quantity of input air provided to each dryer in the first set of dryers is sufficient to achieve drying by evaporation. Correspondingly, when the dryers of the second set of dryers are in use, the second quantities of input and output air are sufficient to dry textiles located within the dryers of the second set of dryers by evaporation. The position of the open second damper is adjusted such that the second quantity of input air provided to each dryer in the second set of dryers is sufficient to achieve drying by evaporation.

The air handling unit may include two separate heat exchangers which operate independently. A first heat exchanger may provide heat to the first quantity of input air delivered to each dryer in the first set of dryers, and the second heat exchanger may provide heat to the second quantity of input air delivered to each dryer in the second set of dryers. The first and second heat exchangers provide heat only when the respective first and second sets of dryers are operating and demanding heated air.

The air handling unit may be located outside the room in which the first and second sets of dryers are located. The textile drying system may include ductwork to route the first and second quantities of input air from the air handling unit to the air input ports of the respective first and second sets of dryers, and to route the first and second quantities of output air from the output ports of the respective first and second sets of dryers to the space outside the room.

BRIEF DESCRIPTION OF THE DRAWINGS

Other objects and advantages of the invention will become apparent upon reading the following detailed description and upon reference to the accompanying drawings in which.

Figure 1:
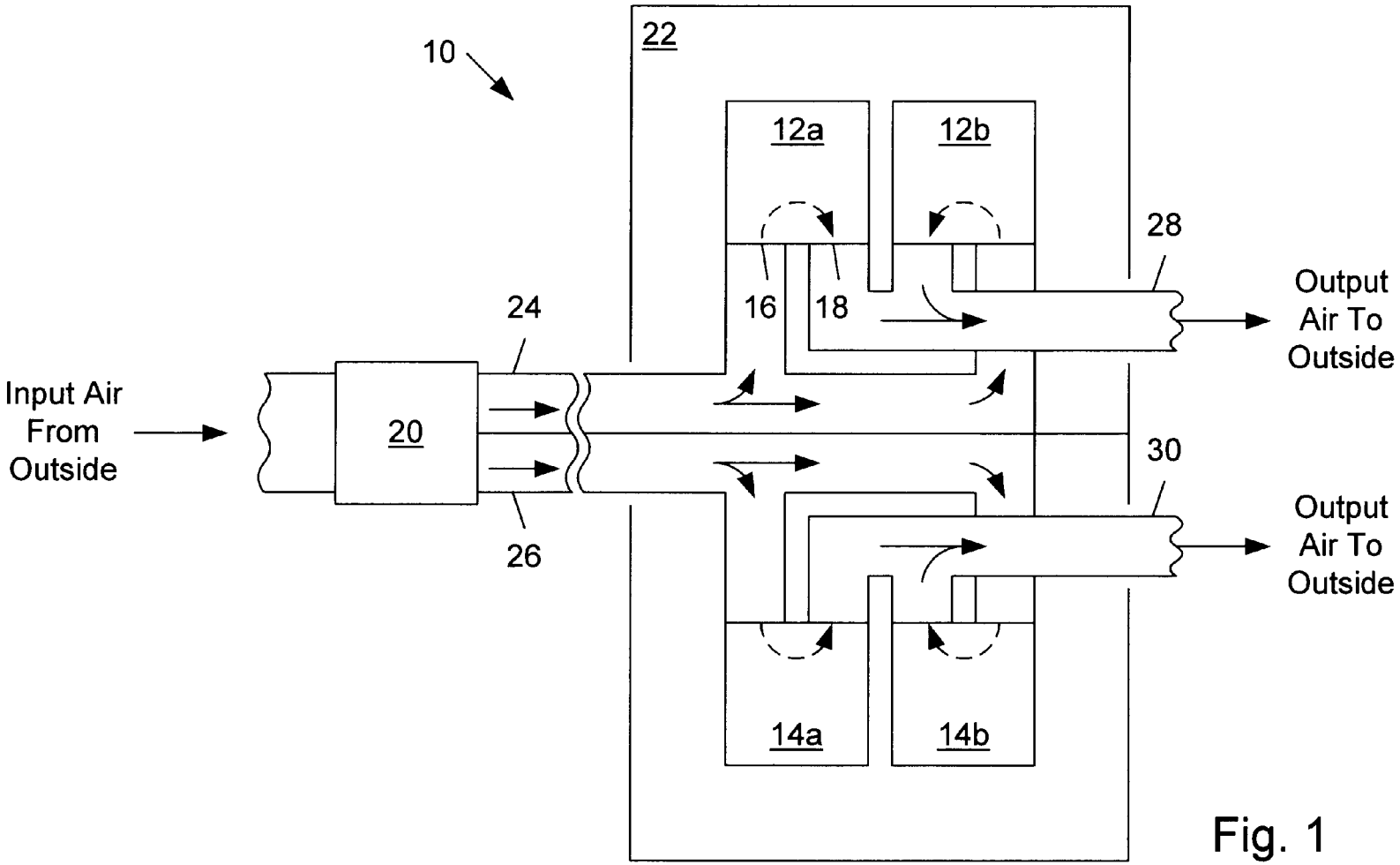
FIG. 1 is a block diagram of one embodiment of a textile drying system in accordance with the present invention, wherein the textile drying system includes an air handling unit supplying air under pressure to two sets of textile drying appliances (i.e., dryers)

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

FIG. 1 is a block diagram of one embodiment of a textile drying system 10 in accordance with the present invention. Textile drying system 10 is used to remove a liquid from textiles. The textiles may be, for example, clean room garments, and the liquid may be water remaining in the garments following a washing procedure. Textile drying system 10 includes a first set of dryers 12*a–b* and a second set of dryers 14*a–b*. Dryers 12*a–b* and 14*a–b* may include a cylindrical drum which rotates about a horizontal axis during use. Dryers 12*a–b* and 14*a–b* accomplish the drying of textiles placed within the drum by causing the drum to rotate, continuously exhausting air from the drum, and drawing replacement (i.e., "makeup") air into the drum. Due to evaporation of the liquid contained within the textiles into the air within the drum, the air exhausted from the drum contains a relatively high concentration of the liquid in vapor form. Substantially all of the liquid contained within the textiles may be eventually removed by such evaporation.

Dryer 12*a* has an air input port 16 and an air output port 18. Dryers 12*b* and 14*a–b* have similar input and air output ports. During use, each dryer inputs a quantity of air through the air input port substantially equal to a quantity of air exhausted through the air output port. In a departure from most common dryers, dryers 12*a–b* and 14*a–b* preferably do not include a fan for exhausting air from the drum or a source of heat (e.g., a gas burner or a steam heat exchanger) for heating the air within the drum. As will be described below, proper quantities of air are provided to the air input ports of dryers 12*a–b* and 14*a–b* by an external source. A suitable dryer is the model Huebsch 150 manufactured by Alliance Laundry Systems (Ripon, Wiss.) and modified as set forth herein to include an air input port and excluding the internal fan and heat source.

Textile drying system 10 also includes an air handling unit 20 providing air from a space outside a room in which dryers 12*a–b* and 14*a–b* are located to the air input ports of dryers 12-*b* and 14*a–b*. As will be described in detail below, air handling unit 20 includes a filter for filtering input air, a fan for pressurizing the input air, and two heat exchangers for heating air provided to dryers 12*a–b* and 14*a–b*. Air handling unit 20 has an air input port and two air output ports, one for each set of dryers.

In the embodiment of FIG. 1, dryers 12*a–b* and 14*a–b* are contained within a room 22. Room 22 may be, for example, within or adjacent to a clean room facility. Air handling unit 20 may be located outside of room 22 as shown in FIG. 1. Textile drying system 10 includes four sets of ductwork for routing of input and exhaust air. A first set of ductwork 24 connects one of the air output ports of air handling unit 20 to the air input ports of dryers 12*a–b*. A second set of duct work 26 connects the other air output port of air handling unit 20 to the air input ports of dryers 14*a–b*. A third set of ductwork 28 routes exhaust air from the air output ports of dryers 12*a–b* to the space outside of room 22, and a fourth set of ductwork 30 routes exhaust air from the air output ports of dryers 14*a–b* to the space outside of room 22.

Air handling unit 20 provides a first quantity of input air from the space outside room 22 to each of the dryers 12*a–b*. Each of the dryers 12*a–b* exhaust a first quantity of output air to the space outside room 22, wherein the first quantities of input and output air are substantially equal. When dryers 12*a–b* are in use, the first quantities of input and output air are sufficient to dry textiles within dryers 12*a–b* by evaporation. Similarly, air handling unit 20 provides a second quantity of input air from the space outside room 22 to each of the dryers 14*a–b*. Each of the dryers 14*a–b* exhaust a second quantity of output air to the space outside room 22, wherein the second quantities of input and output air are substantially equal. When dryers 14*a–b* are in use, the second quantities of input and output air are sufficient to dry textiles within dryers 14*a–b* by evaporation.

It is noted that textile drying system 10 operates without drawing air from room 22 or providing air to room 22. This feature is highly advantageous in a clean room facility where airflows must be carefully controlled in order to draw particulates away from wafer surfaces and processing equipment.

It is also noted that dryers 12*a–b* may operate at the same time, each accepting half a load produced by a washing machine. Similarly, dryers 14*a–b* may be in use at the same time, each accepting half a washer load. Dryers 12*a–b* may operate independently of dryers 14*a–b*, thus dryers 14*a–b* may or may not be operating when dryers 12*a–b* are operating.

Figure 2:
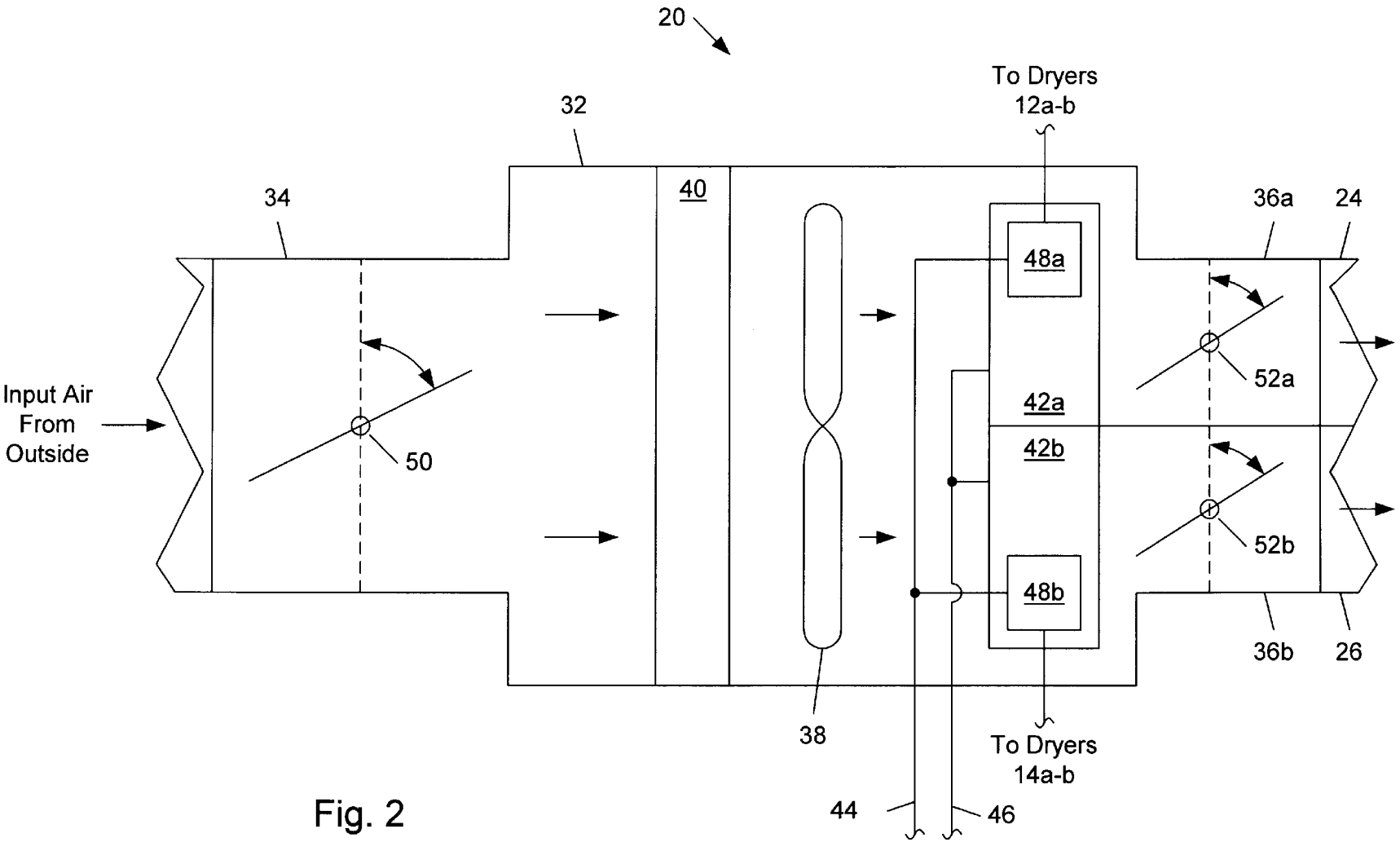
FIG. 2 is a block diagram of one embodiment of the air handling unit of FIG. 1, wherein the air handling unit includes a filter for filtering the air, a fan for pressurizing the air, a first heat exchanger for heating air provided at a first output port, and a second heat exchanger for heating air provided at a second output port.

FIG. 2 is a block diagram of one embodiment of air handling unit 20 of FIG. 1. Air handling unit 20 includes a housing 32 having two opposed ends. An air input port 34 is located at one of the ends of housing 32, and two air output ports 36*a–b* are located at the other end. Air input port 34 draws in air from the space outside of room 22. Air handling unit includes a fan 38 which moves air from air input port 34 toward air output ports 36*a–b*. Fan 38 operates only when dryers 12*a–b* or 14*a–b* are in use. Air output port 36*a* is connected to first set of ductwork 24, and air output port 36*b* is connected to second set of ductwork 26.

Air handling unit 20 also includes a filter 40 positioned between air input port 34 and fan 38. When operating, fan 38 draws input air from air input port 34 through filter 40 and pushes the filtered air toward air output ports 36*a–b*. Filter 40 may include several substantially planar layers of filter elements stacked vertically. One of the filter elements may be a high efficiency particulate air (HEPA) filter element. Such a HEPA filter element removes at least 99.97 percent of particulates having dimensions of 0.3 microns and larger. Alternately, one of the filter elements may be an ultra low penetration air (ULPA) filter element. Such an ULPA filter element removes at least 99.999 percent of particulates having dimensions of 0.12 microns and larger.

Air handling unit 20 also includes a first heat exchanger 42*a* located between fan 38 and air output port 36*a*, and a second heat exchanger 42*b* located between fan 38 and air output port 36*b*. Filtered air propelled by fan 38 flows through heat exchanger 42*a* on its way to air output port 36*a*, and flows through heat exchanger 42*b* on its way to air output port 36*b*. When heat exchanger 42*a* is activated, a heated fluid flows from a supply line 44 through heat exchanger 42*a* to a return line 46. Filtered air passing through heat exchanger 42*a* on its way to air output port 36*a* is heated by heat exchanger 42*a*. The heated fluid may be, for example, hot water, hot oil, or steam. Similarly, when heat exchanger 42*b* is activated, the heated fluid flows from supply line 44 through heat exchanger 42*b* to return line 46, and the air flowing through heat exchanger 42*b* on its way to air output port 36*b* is heated by heat exchanger 42*b*.

Heat exchanger 42*a* includes a modulating valve 48*a* which modulates the flow of the heated fluid through heat exchanger 42*a*. Modulating valve 48*a* is coupled to dryers 12*a–b*. Dryers 12*a–b* demand heated air by sending a signal to modulating valve 48*a* which causes modulating valve 48*a* to open, allowing the heated fluid to circulate through heat exchanger 42*a*. When dryers 12*a–b* are not demanding heated air, modulating valve 48*a* is closed and the heated fluid does not circulate through heat exchanger 42*a*. In addition to the signal from dryers 12*a–b*, modulating valve 48*a* may also receive a temperature signal from a temperature probe or thermostat (not shown) located in first set of ductwork 24. The position of modulating valve 48*a* may be adjusted in response to the temperature signal in order to deliver air heated to a predetermined temperature to dryers 12*a–b*. Heat exchanger 42*b* has a modulating valve 48*b* coupled to dryers 14*a–b* which operates similarly to modulating valve 48*a*.

The heated fluid circulated through heat exchangers 42*a–b* may be, for example, hot water at a temperature of about 165° F. Heat exchangers 42*a–b* may be sized and/or operated such that air at a temperature of approximately 140° F. is delivered to dryers 12*a–b* and dryers 14*a–b* when the dryers demand heated air.

Air handling unit 20 also includes an input damper 50 and two output dampers 52*a–b*. Input damper 50 is located within air input port 34. Input damper 50 is open when dryers 12*a–b* or 14*a–b* are operating, and is otherwise closed. Output damper 52*a* is located within air output port 36*a* and regulates the first quantity of input air provided to dryers 12*a–b*. Output damper 52*a* is open when dryers 12*a–b* are operating, and the position of output damper 52*a* is adjusted such that the first quantity of input air provided to dryers 12*a–b* is sufficient to achieve drying by evaporation. Output damper 52*a* is closed when dryers 12*a–b* are not operating. Output damper 52*b* is located within air output port 36*b* and regulates the second quantity of input air provided to dryers 14*a–b*. Output damper 52*b* is open when dryers 14*a–b* are operating, and the position of output damper 52*b* is adjusted such that the second quantity of input air provided to dryers 14*a–b* is sufficient to achieve drying by evaporation. Output damper 52*b* is closed when dryers 14*a–b* are not operating.

It will be appreciated by those skilled in the art having the benefit of this disclosure that this invention is believed to be a textile drying system suitable for installation in a clean room facility. It is intended that the following claims be interpreted to embrace all such modifications and changes and, accordingly, the specification and drawings are to be regarded in an illustrative rather than a restrictive sense.

What is claimed is:

1. A textile drying system, comprising:

a dryer for drying textiles and having a dryer input port;

a single air handling unit, comprising:

a handling unit input port for receiving air from a space outside a room in which the dryer is located;

a handling unit output port coupled to the dryer input port; and an output damper located within the handling unit output port for regulating a first quantity of air produced by the air handling unit at the handling unit output port; and wherein during use a second quantity of air is exhausted from the dryer to the space outside the room, and wherein the second quantity of air is substantially equal to the first quantity of air.

2. The textile drying system as recited in claim 1, wherein the output damper is closed when the dryer is not operating, and wherein the output damper is open when the dryer is operating, and wherein the output damper is positioned during dryer operation such that the first quantity of input air provided to the dryer is sufficient to dry textiles located within the dryer by evaporation of a liquid contained within the textiles.

3. The textile drying system as recited in claim 1, wherein the air handling unit further comprises a filter for filtering the air received at the handling unit input port.

4. The textile drying system as recited in claim 3, wherein the filter includes a high efficiency particulate air (HEPA) filter element.

5. The textile drying system as recited in claim 3, wherein the filter includes an ultra low penetration air (ULPA) filter element.

6. The textile drying system as recited in claim 1, wherein the first quantity of air is heated by the air handling unit.

7. The textile drying system as recited in claim 1, wherein the air handling unit is located outside of the room, and wherein the textile drying system further includes ductwork to route: (i) the first quantity of air from the handling unit output port to the dryer input port and (ii) the second quantity of air from the dryer to the space outside the room.

8. A textile drying system, comprising:

a first and second sets of dryers, wherein each set of dryers includes at least one dryer, and wherein each dryer has an air input port and an air output port; and a single air handling unit for providing a first quantity of input air from a space outside a room in which the first and second sets of dryers are located to the input port of each dryer of the first set of dryers, and a second quantity of input air from the space outside the room to the input port of each dryer of the second set of dryers;

wherein a first quantity of output air is exhausted from the air output port of each dryer of the first set of dryers to the space outside the room, and wherein the first quantity of output air is substantially equal to the first quantity of input air; and wherein a second quantity of output air is exhausted from the air output port of each dryer of the second set of dryers to the space outside the room, and wherein the second quantity of output air is substantially equal to the second quantity of input air.

9. The textile drying system as recited in claim 8, wherein when the at least one dryer of the first set of dryers is in use, the first quantities of input and output air are sufficient to dry textiles located within the at least one dryer by evaporation of a liquid contained within the textiles.

10. The textile drying system as recited in claim 8, wherein when the at least one dryer of the second set of dryers are in use, the second quantities of input and output air are sufficient to dry textiles located within the at least one dryer by evaporation of a liquid contained within the textiles.

11. The textile drying system as recited in claim 8, wherein the air handling unit includes a filter, and wherein the air handling unit filters the first and second quantities of input air provided to the input ports of the dryers of the respective first and second sets of dryers.

12. The textile drying system as recited in claim 11, wherein the filter includes a high efficiency particulate air (HEPA) filter element.

13. The textile drying system as recited in claim 11, wherein the filter includes an ultra low penetration air (ULPA) filter element.

14. The textile drying system as recited in claim 8, wherein the first quantity of input air is heated by the air handling unit only when the at least one dryer of the first set of dryers is in use, and wherein the second quantity of input air is heated by the air handling unit only when the at least one dryer of the second set of dryers is in use.

15. The textile drying system as recited in claim 8, wherein the air handling unit is located outside of the room, and wherein the textile drying system further includes ductwork to route: (i) the first and second quantities of input air from the air handling unit to the air input ports of the respective first and second sets of dryers, and (ii) the first and second quantities of output air from the output ports of the respective first and second sets of dryers to a space outside of the room.

16. The textile drying system as recited in claim 15, wherein the first and second sets of dryers operate independent of one another, and wherein the air handling system includes:

a first damper to regulate the first quantity of input air delivered to each dryer of the first set of dryers, and a second damper to regulate the second quantity of input air delivered to each dryer of the second set of dryers.

17. The textile drying system as recited in claim 16, wherein when the at least one dryer of the first set of dryers is in use the first damper is in an open position, and wherein when the at least one dryer of the first set of dryers is not in use, the first damper is in a closed position.

18. The textile drying system as recited in claim 16, wherein when the at least one dryer of the second set of dryers is in use the second damper is in an open position, and wherein when the at least one dryer of the second set of dryers is not in use, the second damper is in a closed position.

* * * * *